US012716256B2

(12) United States Patent
Lefebvre

(10) Patent No.: US 12,716,256 B2
(45) Date of Patent: Aug. 25, 2026

(54) SHED

(71) Applicant: Wazza Investments Pty Ltd, Warren (AU)

(72) Inventor: Warren Lefebvre, Warren (AU)

(73) Assignee: Wazza Investments Pty Ltd (AU)

( * ) Notice: Subject to any disclaimer, the term of this patent is extended or adjusted under 35 U.S.C. 154(b) by 231 days.

(21) Appl. No.: 17/895,314

(22) Filed: Aug. 25, 2022

(65) Prior Publication Data

US 2023/0068080 A1 Mar. 2, 2023

(30) Foreign Application Priority Data

Aug. 25, 2021 (AU) ..... 2021221824
Jan. 5, 2022 (AU) ..... 2022100001

(51) Int. Cl.
*E04H 5/08* (2006.01)

(52) U.S. Cl.
CPC ..... *E04H 5/08* (2013.01)

(58) Field of Classification Search
CPC ..... E04H 5/08; E04H 7/30; E06B 3/365
USPC ..... 52/264
See application file for complete search history.

(56) References Cited

U.S. PATENT DOCUMENTS 109,692 A * 11/1870 Veer ..... E05C 19/06 292/80
386,221 A * 7/1888 Settlemire ..... E06B 3/365 109/59 R
475,686 A * 5/1892 Hauck ..... E05B 65/0864 292/163
508,635 A * 11/1893 Reeves ..... E05C 9/043 5/284
731,982 A * 6/1903 Valentine ..... A61L 2/18 422/292
1,048,989 A * 12/1912 McDonnell ..... E05C 19/026 292/18
1,094,143 A * 4/1914 Hagstrom ..... E05B 65/0075 70/118
1,140,517 A * 5/1915 Lewis ..... E05C 1/04 292/210
1,317,820 A * 10/1919 Phillips ..... E05C 9/043 187/331

(Continued)

FOREIGN PATENT DOCUMENTS

CN 102587714 B 2/2014
CN 204804395 U 11/2015

(Continued)

OTHER PUBLICATIONS

Machine Translation of JP S58-27194 (Year: 1983).*
AU 2022100001 Office Action, Mar. 3, 2022.

*Primary Examiner* — James M Ference
(74) *Attorney, Agent, or Firm* — Adam K. Sacharoff; Much Shelist, P.C.

(57) ABSTRACT

A storage shed for storing items such as grain, equipment, implements and/or machinery, the storage shed including: a floor; one or more spaced apart walls mounted on the floor; a roof; wherein the walls and roof and floor provide a storage volume and are sealed together to inhibit ingress of vermin and to maintain a selected ambient pressure inside the storage volume, and a pressure relief valve operatively connected to the floor, roof or wall to relieve internal pressure in the storage shed.

21 Claims, 15 Drawing Sheets

(56) References Cited

U.S. PATENT DOCUMENTS 1,355,371 A * 10/1920 Welsh ..... E05C 17/446 292/57
1,448,298 A * 3/1923 Hight ..... E05C 1/14 16/83
1,563,879 A * 12/1925 Thompson ..... E05C 17/50 292/136
1,564,183 A * 12/1925 Prinzler ..... E05C 17/52 292/76
1,709,915 A * 4/1929 Morris ..... E05C 9/08 292/241
1,723,007 A * 8/1929 Bittorf ..... E05C 1/04 49/394
1,745,588 A * 2/1930 Shodron ..... E04H 5/08 52/DIG. 9
1,755,580 A * 4/1930 Haseltine ..... E05C 9/028 292/161
1,792,540 A * 2/1931 Johnson ..... E05C 1/04 292/57
1,981,417 A * 11/1934 Kreutzer ..... E04H 5/08 52/234
1,981,418 A * 11/1934 Kreutzer ..... E04H 5/08 52/192
1,981,419 A * 11/1934 Kreutzer ..... E04H 5/08 52/783.11
2,069,883 A * 2/1937 Hennicke ..... E05C 9/041 49/276
2,123,188 A * 7/1938 Hurlbut ..... E05C 17/443 292/7
2,169,692 A * 8/1939 Hansen ..... E05C 9/048 292/40
2,185,532 A * 1/1940 Waterman ..... E04H 5/08 454/365
2,422,987 A * 6/1947 Roberts ..... E04H 5/08 454/368
2,899,884 A * 8/1959 Herbruck ..... B65D 90/32 220/721
2,915,791 A * 12/1959 Hauf ..... E04B 1/8218 52/270
2,927,665 A * 3/1960 Hauf ..... E04B 1/6803 52/584.1
3,086,383 A * 4/1963 Scott ..... E05C 9/04 70/156
3,298,728 A * 1/1967 Dye ..... E05B 63/125 292/62
3,555,758 A * 1/1971 Schroter ..... E04D 3/351 52/489.1
3,563,578 A * 2/1971 Meller ..... B65D 88/522 217/65
3,582,122 A * 6/1971 Foster ..... E05B 63/20 292/DIG. 21
3,646,874 A * 3/1972 Hamerski ..... A01F 25/16 454/238
3,737,183 A * 6/1973 Pastva, Jr. ..... E05B 83/10 292/7
3,833,963 A * 9/1974 Waters ..... E05C 17/54 292/343
4,009,520 A * 3/1977 Sukup ..... F26B 9/103 34/233
4,057,295 A * 11/1977 Liet ..... B65D 90/024 52/192
4,178,024 A * 12/1979 Wagner ..... E05C 9/1825 292/148
4,204,369 A * 5/1980 Hubbard ..... E05B 65/1066 49/366
4,231,199 A * 11/1980 Gomez ..... E04B 1/04 52/204.2
4,306,490 A * 12/1981 Kallestad ..... F26B 9/063 34/233
4,381,632 A * 5/1983 Geitner ..... E04B 1/3483 52/282.1
4,453,351 A * 6/1984 Moore ..... E04H 7/22 52/192
4,583,300 A * 4/1986 Mast ..... F26B 9/063 454/182
4,710,206 A * 12/1987 Allen ..... A23B 2/708 96/144
4,759,577 A * 7/1988 Thomas, III ..... E05C 19/004 292/338
4,790,578 A * 12/1988 Barrera ..... E05B 65/0007 292/205
4,862,661 A * 9/1989 Moore ..... E04H 7/30 52/247
5,098,138 A * 3/1992 Vandewege ..... E05C 19/004 292/338
5,110,164 A * 5/1992 Whiteman ..... E05B 83/10 292/7
5,154,454 A * 10/1992 Hollaway ..... E05B 65/1046 292/DIG. 60
5,353,564 A * 10/1994 Hansen ..... F25D 23/061 454/236
5,398,982 A * 3/1995 Watson, Jr. ..... E05C 3/048 292/259 R
5,531,492 A * 7/1996 Raskevicius ..... E05B 63/20 292/335
5,590,919 A * 1/1997 Germano ..... E06B 3/365 292/DIG. 21
5,595,037 A * 1/1997 Paques ..... E04H 7/30 52/249
5,829,209 A * 11/1998 Keyl ..... E04H 7/30 52/249
6,152,059 A * 11/2000 Del Raso ..... B63B 25/082 114/227
6,321,411 B1 * 11/2001 Ikejiri ..... E05F 5/06 16/85
6,324,799 B1 * 12/2001 Salvitti ..... E04H 5/10 52/287.1
6,401,412 B1 * 6/2002 Cooper ..... E04D 3/3607 52/90.2
7,250,000 B2 * 7/2007 Daniels ..... E04D 12/004 454/250
8,250,811 B2 * 8/2012 Zijlstra ..... E05C 1/10 292/64
8,256,157 B1 * 9/2012 Dunklau ..... A01M 13/003 43/125
9,238,926 B2 * 1/2016 Guerrero ..... E05B 17/2076
9,428,940 B1 * 8/2016 Patrick ..... E05C 1/16
9,497,955 B1 * 11/2016 Rogacki ..... A01M 13/003
9,556,615 B1 * 1/2017 Zettell ..... E04C 2/388
10,184,685 B1 * 1/2019 Borcherding ..... E04H 5/02
10,214,948 B2 * 2/2019 Richmond ..... E05C 5/02
10,316,556 B2 * 6/2019 Richmond ..... E05C 21/00
10,822,849 B1 * 11/2020 Musgrave ..... E05C 19/003
10,934,749 B2 * 3/2021 Braz ..... E05C 1/04
2003/0097812 A1 * 5/2003 Molina ..... E04G 17/075 52/742.14
2008/0039006 A1 * 2/2008 Vroege ..... F24F 7/08 454/239
2008/0251514 A1 * 10/2008 Fitzpatrick ..... A23L 3/3409 220/86.1
2009/0272024 A1 * 11/2009 Rogacki ..... A01M 13/003 43/125
2010/0273412 A1 * 10/2010 Will ..... F24F 11/0001 454/238
2014/0230346 A1 * 8/2014 Blumberg ..... E04H 7/00 52/302.1
2014/0272046 A1 * 9/2014 Micka ..... A01F 25/22 426/419
2016/0251868 A1 * 9/2016 Close ..... E04H 7/18 52/293.1
2021/0040733 A1 * 2/2021 Morrow ..... E04D 13/1612
2023/0068080 A1 * 3/2023 Lefebvre ..... E04H 5/08

FOREIGN PATENT DOCUMENTS

CN 209225944 U 8/2019
CN 106035634 B 11/2019
CN 211499966 U 9/2020

(56) References Cited

FOREIGN PATENT DOCUMENTS

| | | | | |
|---|---|---|---|---|
| JP | S5827194 | U | 2/1983 | |
| RU | 2679053 | C1 | 2/2019 | |
| WO | WO-2013036591 | A1 * | 3/2013 | ..... B65D 88/74 |

* cited by examiner front section of roof showing sealing of roof

SHED

TECHNICAL FIELD

The present technology relates generally to sealed storage facilities.

BACKGROUND OF THE INVENTION

Sealed silos can store grain, but they are limited in their storage to only that use. Silos are totally unsuitable for storing machinery and fertiliser, equipment and the like.

Sheds are more flexible in their application, but are limited to storing and housing machinery, equipment, fertiliser, and other items that can be sealed in their own containers. This kind of shed is totally unsuitable for storing grain.

The present invention seeks to ameliorate one or more of the above mentioned disadvantages.

SUMMARY OF THE INVENTION

Broadly, the present invention seeks to provide a flexible storage solution for grain, machinery and other items, which provides protection to stored items from the sun and the elements, plus a seal from vermin.

In accordance with an aspect of the present invention there is provided a storage shed for storing items such as grain, equipment, implements and/or machinery, the storage shed including:

- a floor;
- one or more spaced apart walls mounted on the floor;
- a roof;
- wherein the walls and roof and floor provide a storage volume and are sealed together to inhibit ingress of vermin and to maintain a selected ambient pressure inside the storage volume, and
- a pressure relief valve operatively connected to the floor, roof or wall to relieve internal pressure in the storage volume.

In accordance with another aspect of the present invention there is provided a pressure relief valve configured to be connected to a wall, roof or floor of a shed, the pressure relief valve including:

- a housing including:
  - a sump for storing a working liquid;
  - a gas inlet chamber;
  - a gas outlet chamber; and
- a gas inlet in fluid communication with the housing;
- a gas outlet in fluid communication with the housing;
- a baffle in the housing,
- wherein the gas inlet chamber and the gas outlet chamber are separated by a baffle which extends into the sump.

In accordance with still another aspect of the present invention there is provided a floor for a storage shed, the floor including:

- a concrete slab; and
- a bund mounted on the concrete slab, the bund forming a peripheral wall to provide at least a substantial portion of a base periphery of the storage shed.

In accordance with yet another aspect of the present invention there is provided a door catch which includes:

- a base plate; and
- a catch plate mounted on top of the base plate for catching a door latch against one face.

In one embodiment the base plate is configured to be set into the concrete floor of the silo or shed.

In accordance with a yet further aspect of the present invention there is provided a door for a storage silo or storage shed, the door including:

- a door panel;
- one or more hinges disposed on the door panel for swinging the door between a closed and an open position;
- a latch assembly which includes:
  - a rotatable locking post;
  - a handle for rotating the rotatable locking post between a locked position and an unlocked position; and
  - a latch plate mounted to the base of the rotatable locking post and disposed at a base of the door for latching onto a catch plate when the rotatable locking post is in the locked position, and for clearing the catch plate when the rotatable locking post is in the unlocked position.

In one embodiment the bund includes a substantially vertical wall on an outside face so that a wall sheet can fasten thereagainst.

In one embodiment the vertical wall is scalloped to receive a sheet having a cooperating scalloped or sinusoidal profile thereagainst.

In one embodiment the bund includes an angled wall on an inside face to facilitate drainage or sliding of bulk grain or other material onto the floor for removal.

In one embodiment the bund includes a vertical wall on a portion of the inside face to improve strength.

In accordance with yet another aspect of the present invention there is provided a roof flashing element which is configured to facilitate a roof seal, the roof flashing element in the form of a Z-section which includes an angle on either side of a central spine section, wherein portions of the Z-section are configured to receive one or more sealant beads.

In accordance with still another aspect of the present invention there is provided a door mounted fumigation inlet for a pressurised grain storage silo or grain storage shed.

In one embodiment the fumigation inlet includes a valve for controlling fumigant access to the silo or shed.

In one embodiment the valve is mounted substantially on an inside face of the door.

In one embodiment the fumigation inlet includes a housing mounted on the door, the housing being to house the valve.

In one embodiment the valve is a ball valve.

In one embodiment there is provided a flange extending from one angle of the Z-section to provide a channel adjacent the angle section.

In one embodiment the channel is on one side of the spine and the angle is on the other side of the angle section.

In one embodiment the gas inlet chamber and gas outlet chamber are disposed above the sump, adjacent the baffle.

In one embodiment the sump includes an inlet portion and an outlet portion, the inlet portion being disposed on an inlet side of the baffle and the outlet portion is on the other side of the baffle.

In one embodiment the working liquid for storing in the sump is oil.

In one embodiment the housing includes an indicator for indicating fluid level in the sump.

In one embodiment the indicator includes a window in the housing.

In one embodiment the window extends across both sides of the baffle to indicate the level of liquid on both inlet and outlet portions of the sump.

In one embodiment the indicator includes two windows in the housing.

In one embodiment one window is on one side of the baffle, while another window is on the other side of the baffle, so as to indicate the level on both inlet and outlet sides of the baffle.

In one embodiment the gas inlet is disposed in an upper portion of the housing, so as to introduce gas to the gas inlet chamber.

In one embodiment the floor includes a bund disposed around at least a portion of the perimeter of the floor so that a base portion of the walls may attach thereto.

In one embodiment the bund includes an embankment having a vertical wall on an outer portion for to receive a base portion of the walls thereagainst.

In one embodiment the bund includes an angled upper wall on an inside portion to facilitate draining or cleaning of bulk material such as grain from the walls and onto the floor.

Advantages of the Invention

To store grain or similar products for long periods of time, allowing the customer to choose when they sell and protect product.

DESCRIPTION OF EMBODIMENTS

Figure 1:
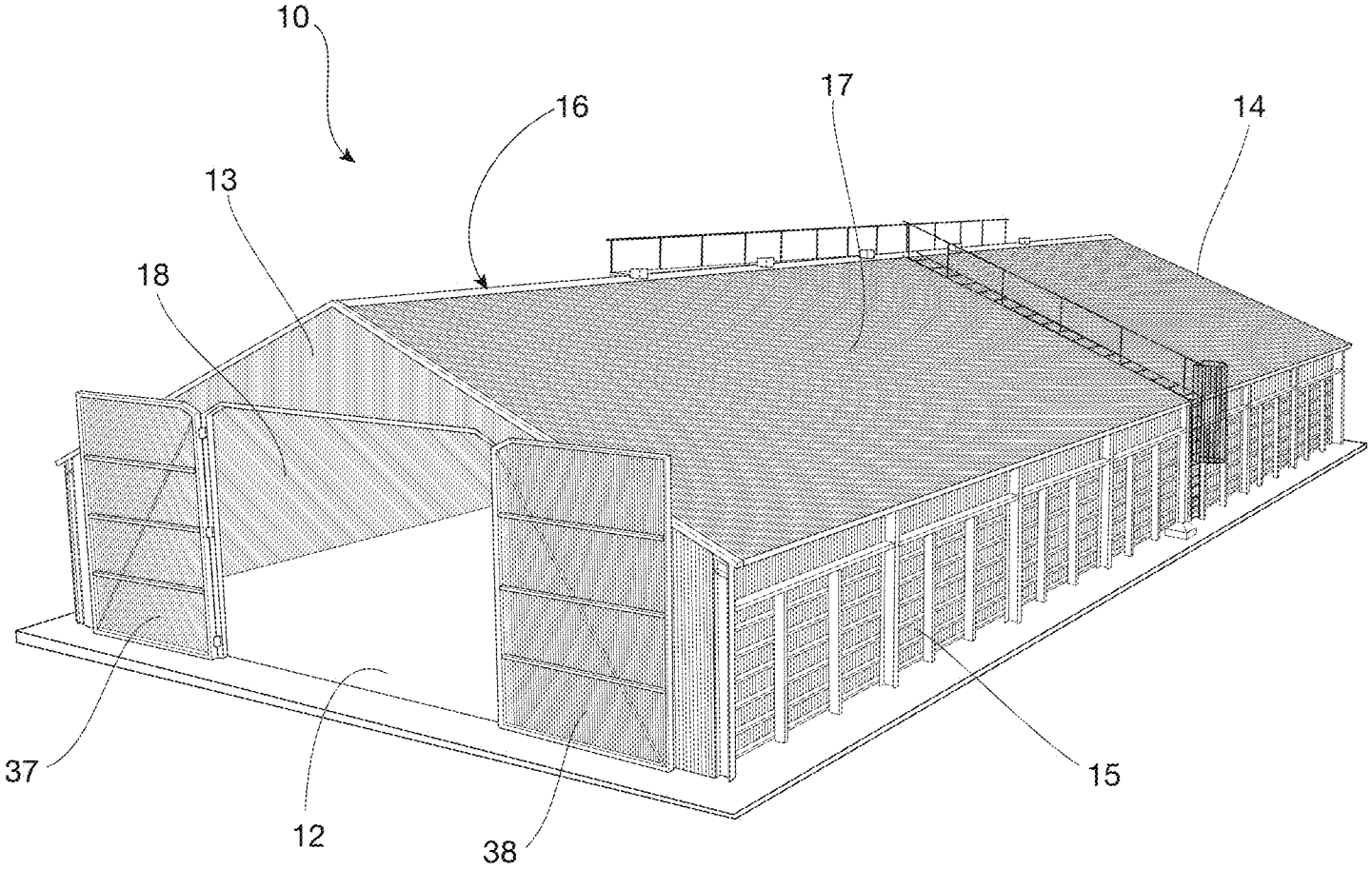
FIG. 1 is a perspective view from above, one side and in front, of a shed in accordance with an embodiment of the present invention.
Figure 2:
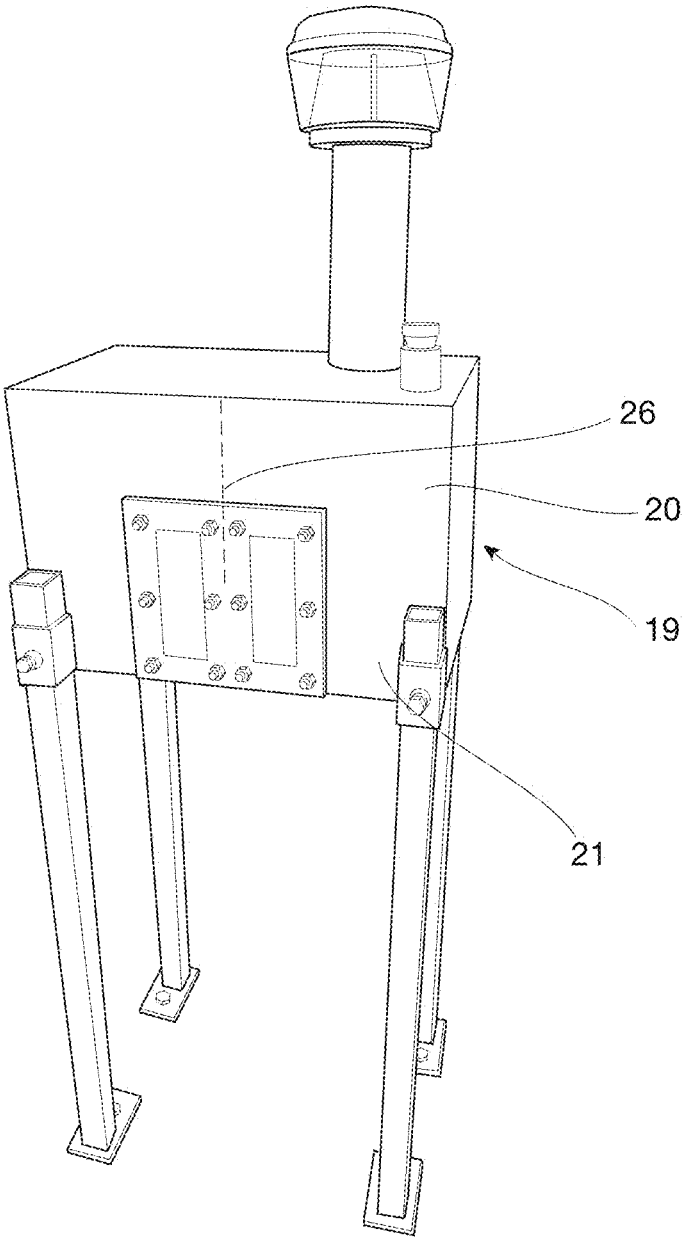
FIG. 2 is a perspective view of a pressure relief valve in accordance with an embodiment of the present invention, the valve shown installed on a shed.
Figure 3:
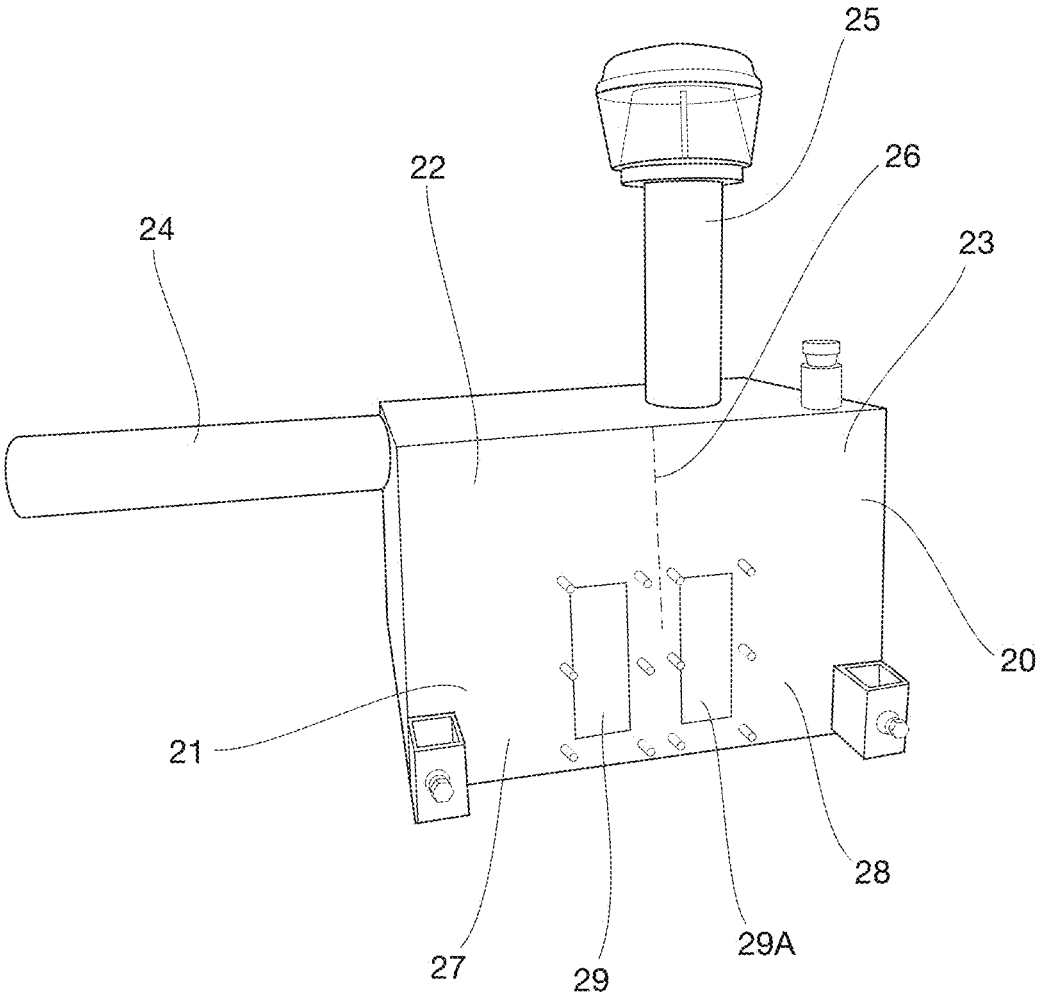
FIG. 3 is a perspective view of the pressure relief valve of FIG. 2 but shown standing alone before installation in the shed.
Figure 4:
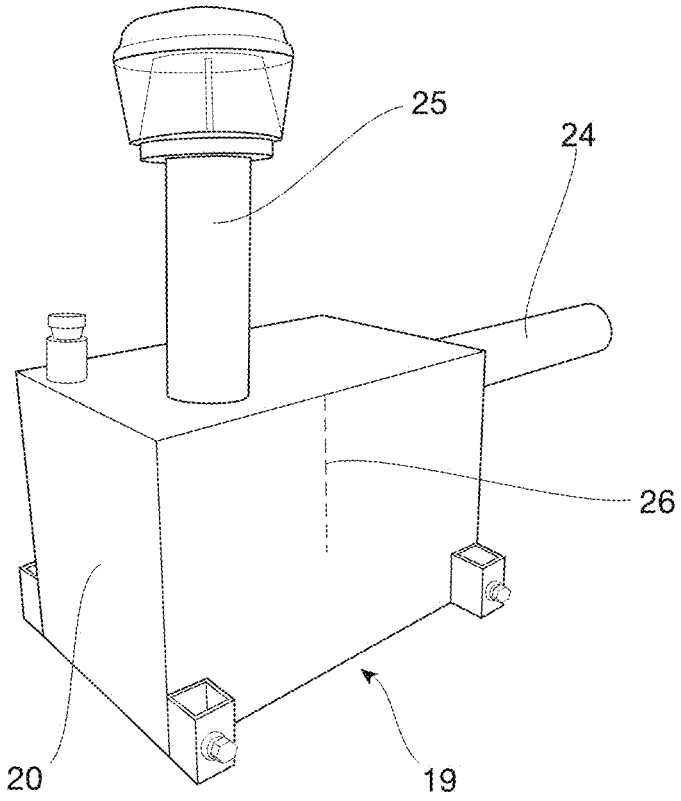
FIG. 4 is a rear perspective view of the pressure relief valve of FIGS. 2 and 3 shown before installation.

Referring to the drawings there is shown a shed generally indicated at 10, which is a flexible storage solution for grain, machinery and other items, which provides protection to stored items from the sun and the elements, plus a seal from vermin.

The storage shed 10 includes a floor 12, one or more spaced apart walls, being front 13, back 14, left side 15, and right side 16 mounted on the floor 12; and a roof 17. The walls 13, 14, 15 and 16 and roof 17 and floor 12 are arranged to provide a storage volume 18 and are sealed together to inhibit ingress of vermin and to maintain a selected ambient pressure inside the storage volume 18.

There is provided a pressure relief valve 19 operatively connected to the rear wall 14 to relieve internal pressure in the storage volume 18. The valve relieves pressure from excess heat from the sun's energy bearing on to the walls and roof of the shed. The pressure relief valve 19 is configured to be connected to a wall, roof or floor of a shed, and it includes: a housing 20 including a sump 21 for storing a working liquid (not shown); a gas inlet chamber 22; a gas outlet chamber 23; and a gas inlet 24 in fluid communication with the housing 20. There is also, in the pressure relief valve 19, a gas outlet 25 in fluid communication with the housing 20, and a baffle (shown in dashed lines 26) in the housing 20, and the valve 19 is arranged such that the gas inlet chamber 22 and the gas outlet chamber 23 are separated by the baffle 26 which extends from an inside top wall of the housing 20, down into the sump 21. The magnitude of the pressure allowed to build up in the gas inlet chamber 22 (and by extension, the gas inlet 24 and the storage volume 18 to which it is connected is governed by the depth of the baffle into the sump. In this case, the baffle extends about 10 mm down into the fluid (in this case, oil) in the sump 21 so that the relief pressure is about 10 kPa. If the user desires to build up a higher pressure in the storage volume 18, then the baffle is to be extended further into the oil, or the oil is filled up higher.

In one embodiment the sump includes an inlet portion 27 and an outlet portion 28, the inlet portion 27 being disposed on an inlet side of the baffle 26 and the outlet portion is on the outlet side of the baffle 26.

The housing 20 also includes an indicator 29 for indicating oil level in the sump 21. The indicator 29 includes a window 29A in the housing 20. The window 29A extends across both sides of the baffle 26 to indicate the level of oil on both inlet 27 and outlet 28 portions of the sump 21, but there may be provided two separate windows, as shown in the Figures, one window being on one side of the baffle 26, while another window is on the other side of the baffle 26, so as to indicate the level on both inlet 27 and outlet 28 sides of the baffle 26.

The gas inlet is disposed in an upper portion of the housing, so that in operation it introduces fumigant from the storage volume 18 to the gas inlet chamber 22. The fumigant then is forced under the surface of the oil on the inlet side 27 of the sump 21, under the baffle 26, and then out to the other side 28 of the sump 21 and out through the outlet 23.

The floor 12 for the storage shed 10 includes a concrete slab 11 and a bund 9 mounted on the concrete slab 11, the bund 9 forming a peripheral embankment 8 to provide at least a substantial portion of a base periphery of the storage shed 10. The bund 9 includes a substantially vertical wall 7 on an outside face 6 so that a wall sheet 5 can fasten thereagainst. The vertical wall 7 is scalloped to receive the wall sheet 5 which has cooperating scallops or corrugations. The bund 9 further includes an angled wall 4 on an inside face 3 to facilitate drainage or sliding of bulk grain or other material onto the floor for removal. The angled wall 4 extends at about 45 degrees to the vertical, atop a vertical wall portion 2 of the inside face 3 to improve strength.

The front wall 13 has a double door arrangement 30. The doors are hinged and include P-seals or like seals along their edges to facilitate sealing. There is provided an angle disposed on the floor 12 to provide a shoulder against which the door can close and seal, but which also allows machinery to drive over for ease of storage of various implements and equipment.

The door arrangement 30 further includes a catch 32 which includes a base plate 33 and a catch plate 34 mounted on top of the base plate 33 for catching a door latch 35 against one face 36. In use, the base plate 33 is set into the concrete floor 12 of the silo or shed so that it is flush with the floor 12. The catch plate 34 extends above the floor a few mm, which is roughly its thickness.

The door arrangement 30 includes door panels 37, 38, each one including one or more hinges disposed thereon for swinging the door between a closed and an open position. The door arrangement 30 includes a latch assembly 40 which include a rotatable locking post 42, a handle 44 for rotating the rotatable locking post 42 between a locked position and an unlocked position; and a latch 35 in the form of a latch plate 45 mounted to the base of the rotatable locking post 42 and disposed at a base of the door 37 or 38 for latching onto the catch plate 34 when the rotatable locking post 42 is in the locked position, and for clearing the catch plate 34 when the rotatable locking post 42 is in the unlocked position.

To further facilitate sealing, there is provided a roof arrangement 50 which includes a flashing element 52 which is configured to facilitate a roof seal, the roof flashing element being in the form of a Z-section 53 which includes an angle 54, 55 on either side of a central spine section 56, wherein portions of the Z-section are configured to receive one or more sealant beads.

There is also provided a door mounted fumigation inlet 60 for the shed 10. The fumigation inlet 60 includes a valve 62 for controlling fumigant access to the shed 10, and the valve 62 is mounted substantially on an inside face of the door panel 37 or 38. The fumigation inlet 60 further includes a housing 65 mounted on the door, the housing 65 being to house the valve 62. The valve 62 is a ball valve 63.

Figure 5:
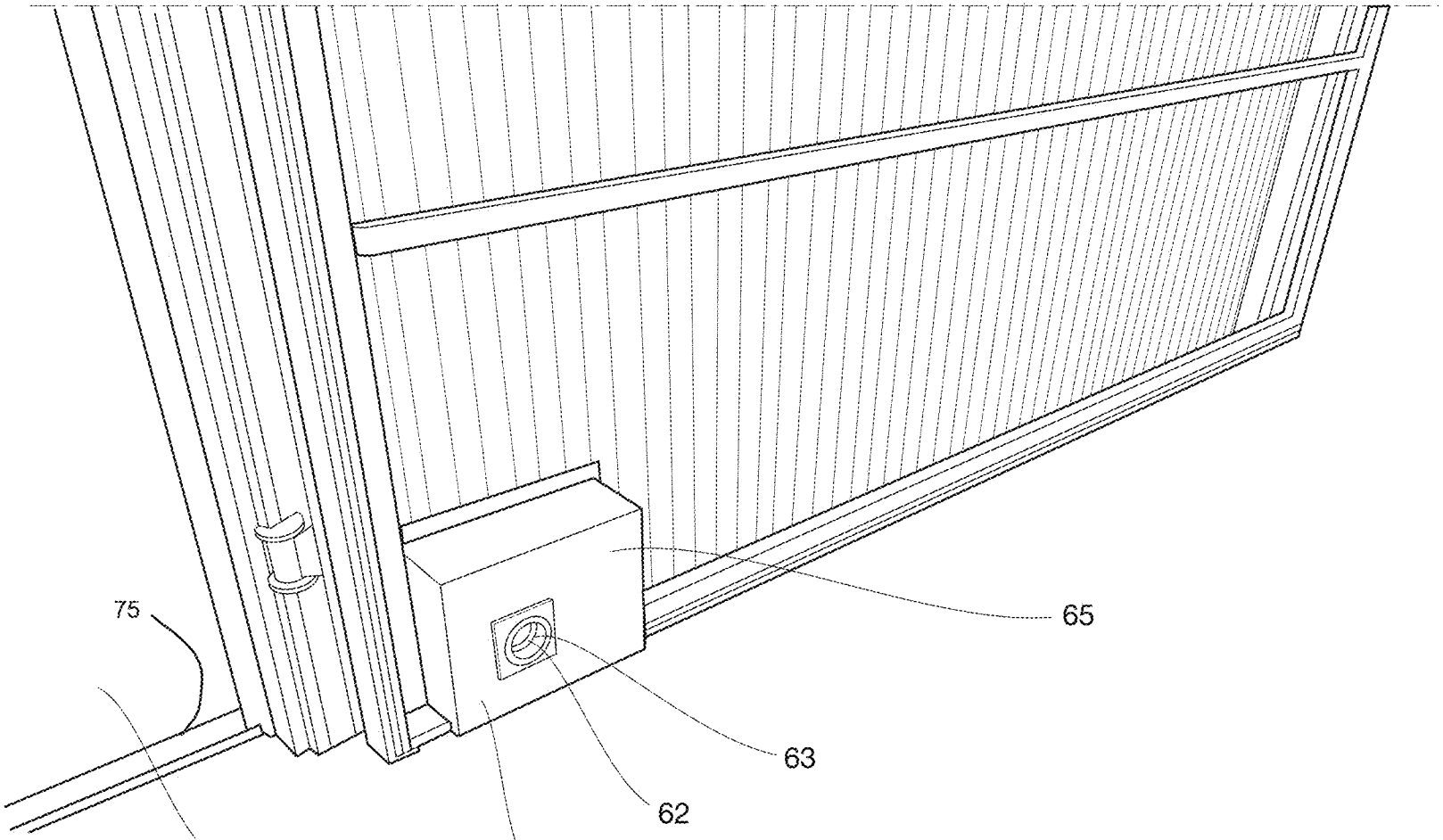
FIG. 5 is a perspective view of an inlet valve and housing mounted in the door of the shed.
Figure 6:
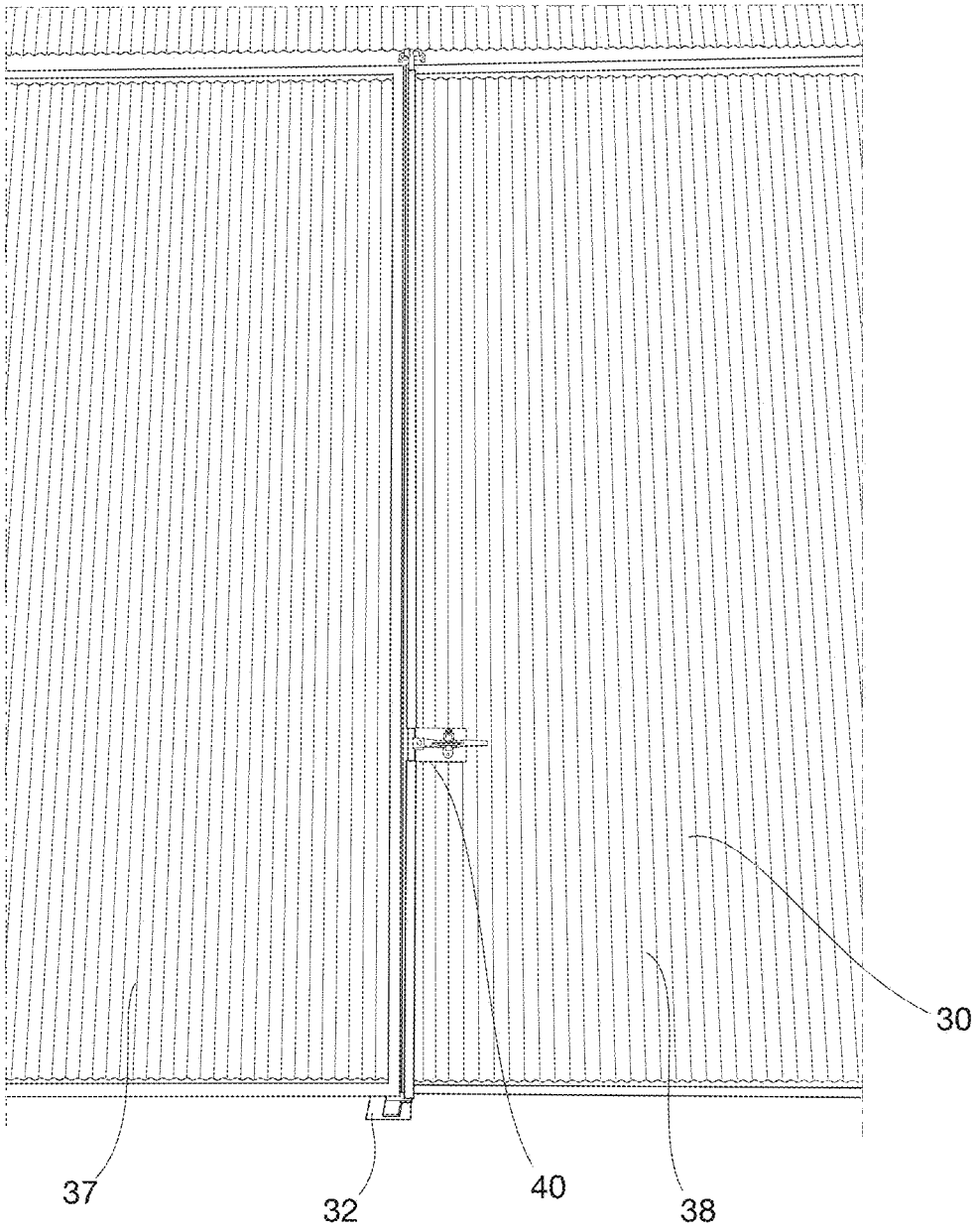
FIG. 6 is a front view of a pair of double doors for the shed of FIG. 1.
Figure 7:
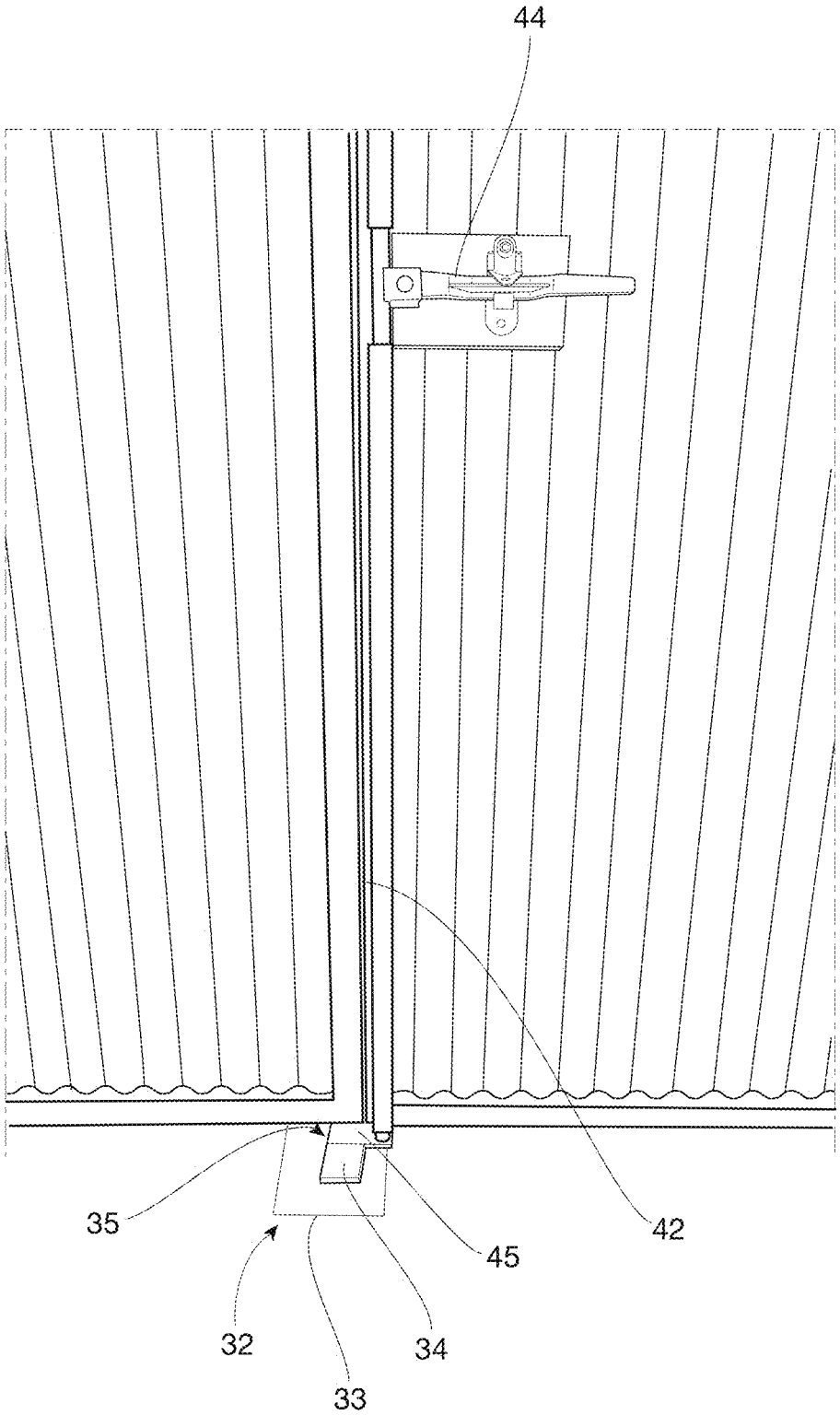
FIG. 7 is a front detail view of the doors of FIG. 6 showing the handle and the latch.
Figure 8:
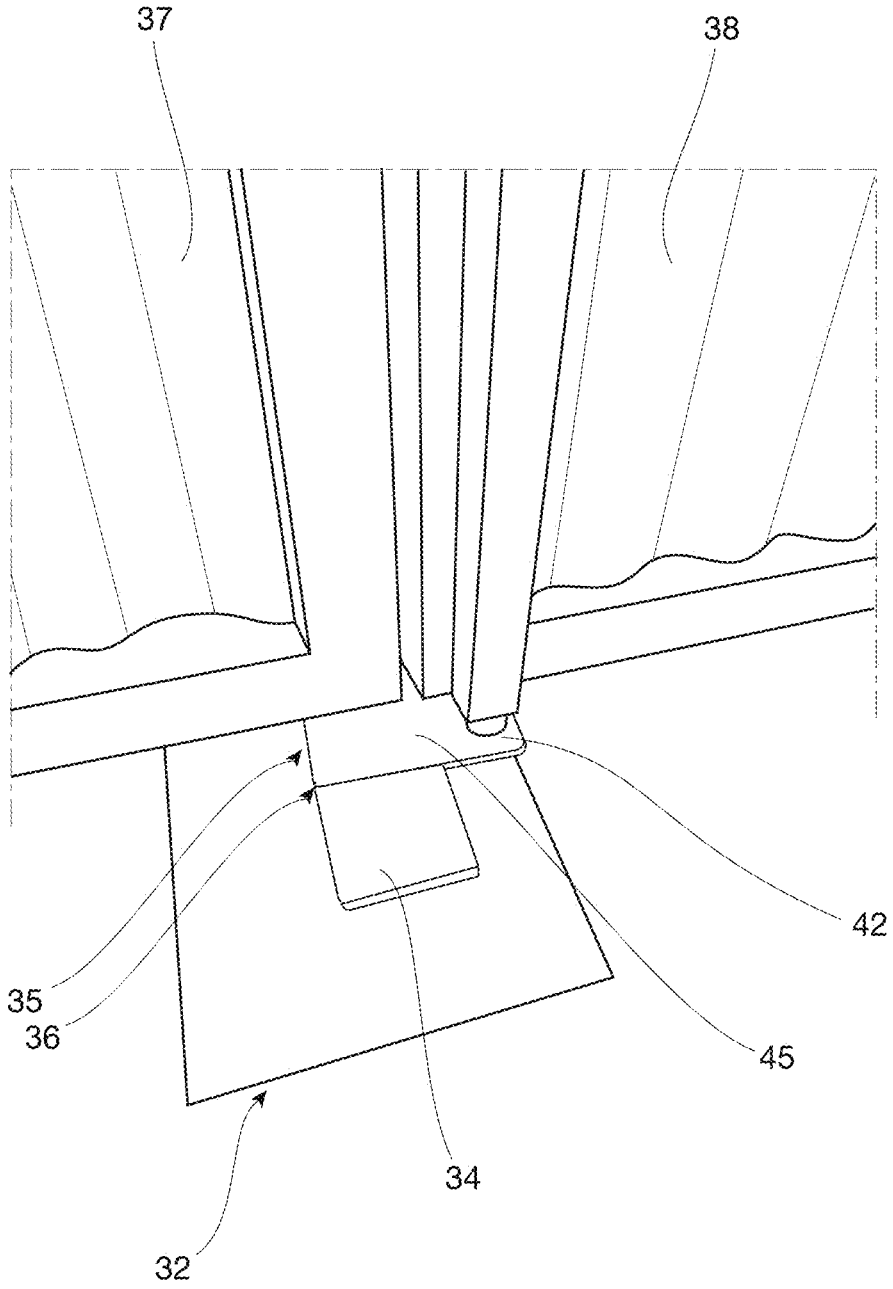
FIG. 8 is a plan/perspective view of the doors of FIGS. 6 and 7 showing a floor mounted catch and the latch.
Figure 9:
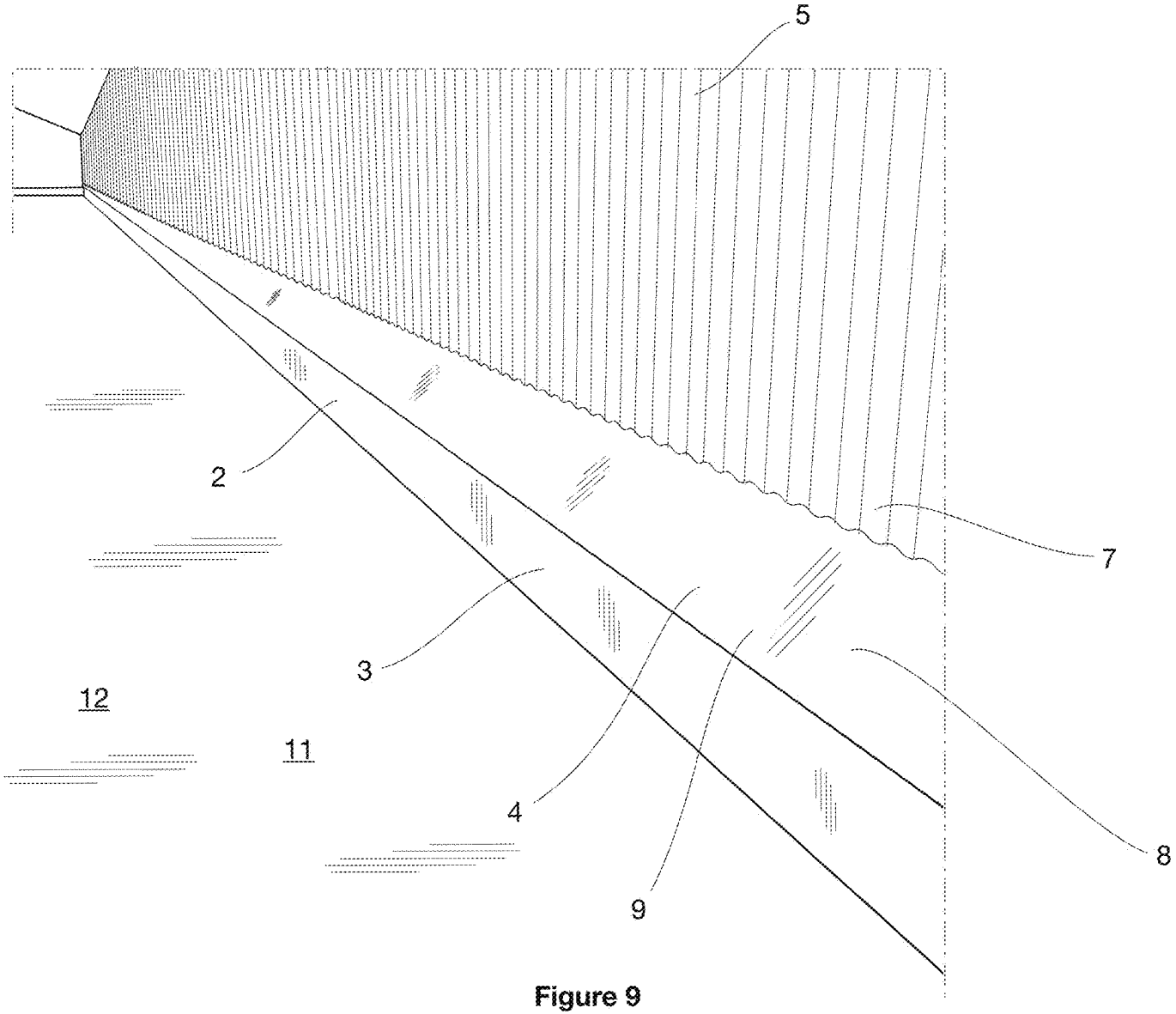
FIG. 9 is a perspective view of an inside of the shed, showing the bund disposed around the perimeter of the wall at the base.
Figure 10:
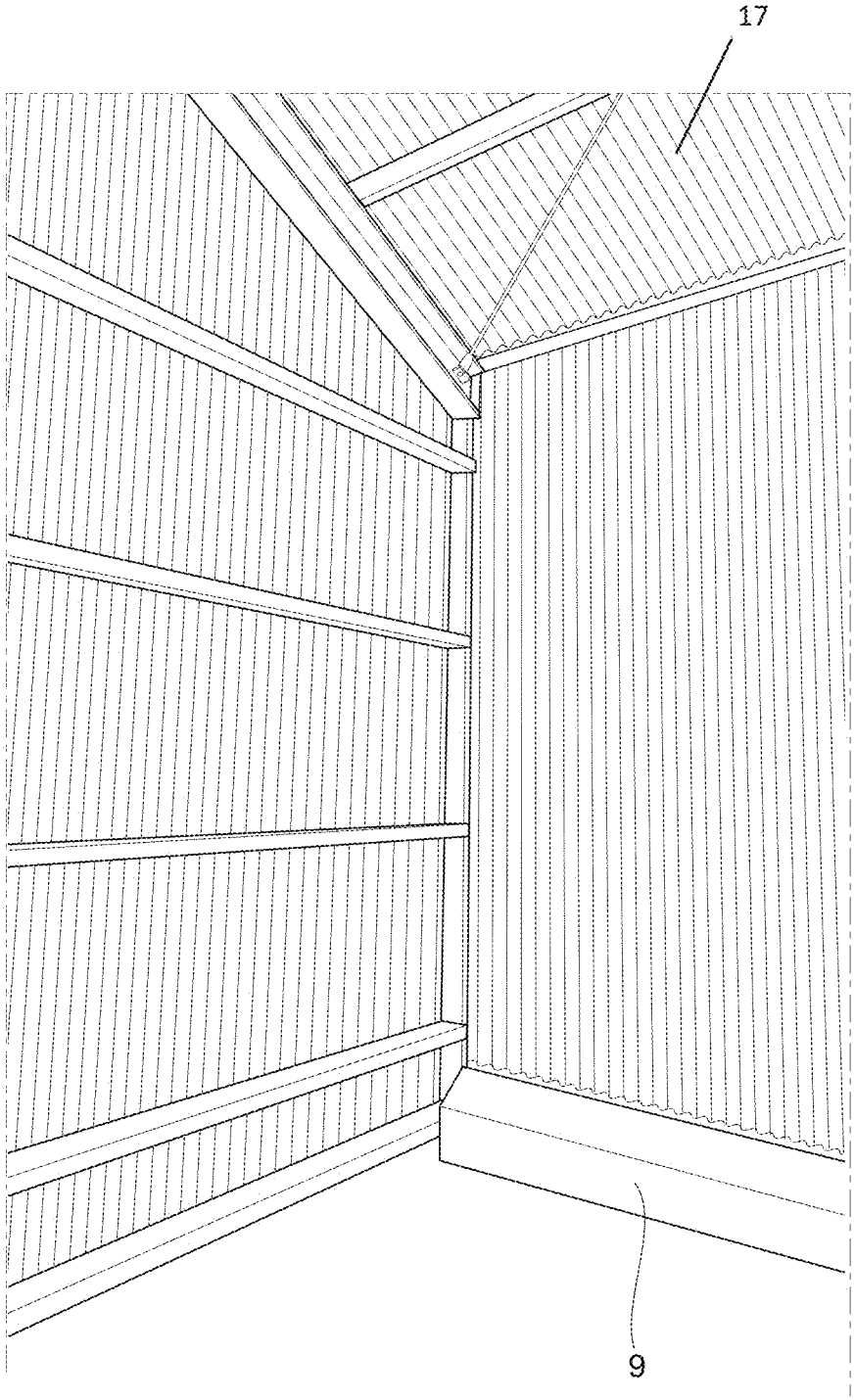
FIG. 10 is a perspective view of an inside corner (back, distal the door) which shows the bund and the inside of the wall sheets.
Figure 11:
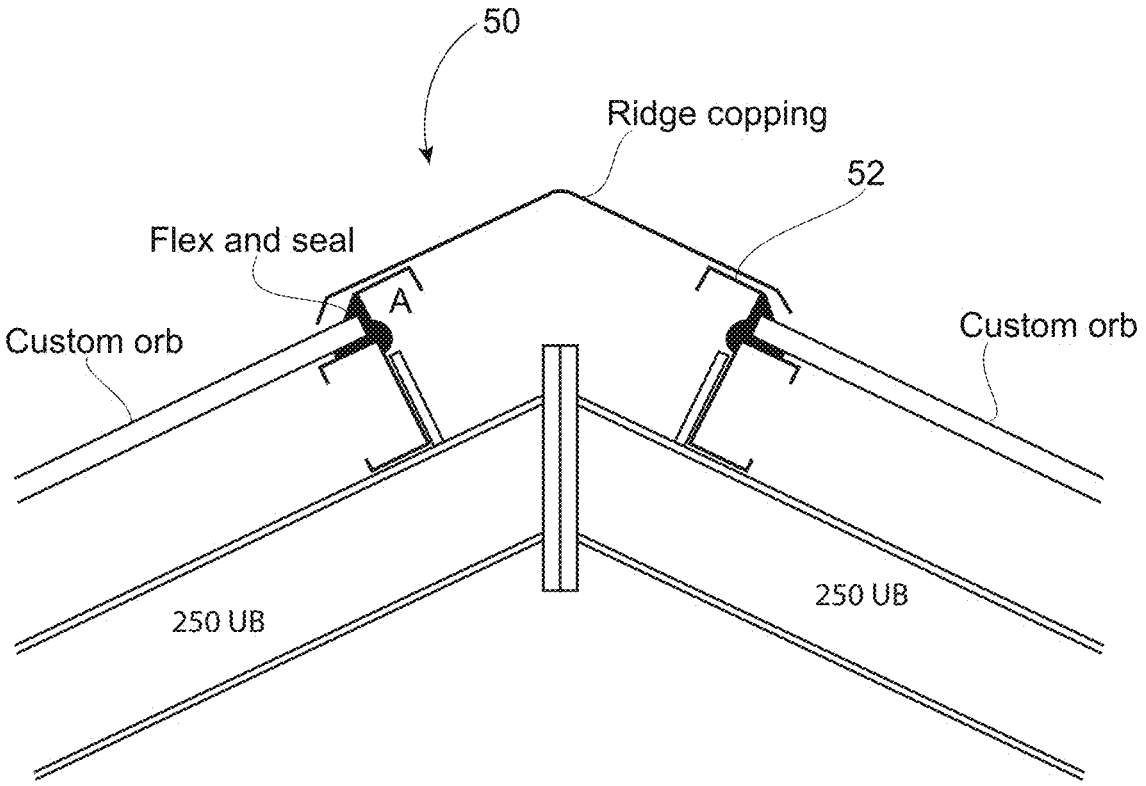
FIG. 11 is a front section view of a roof structure of the shed of FIG. 1, showing sealing of the roof.
Figure 12:
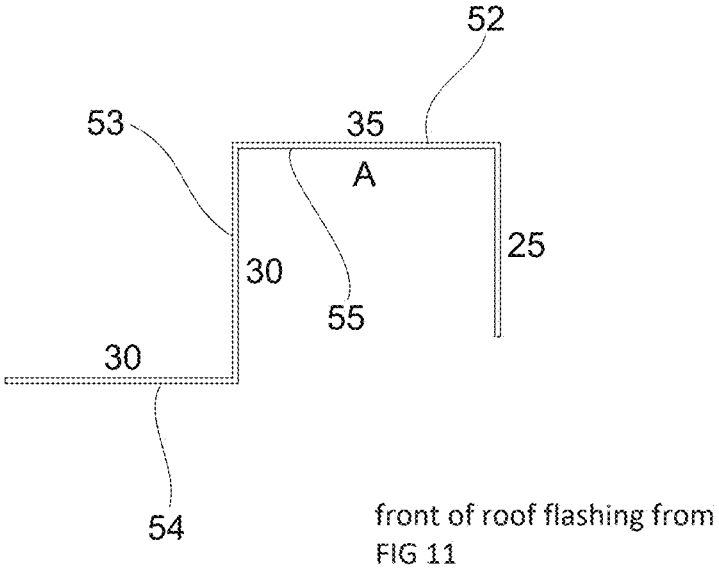
FIG. 12 is a front section detail view of a roof flashing shown in FIG. 11.
Figure 13:
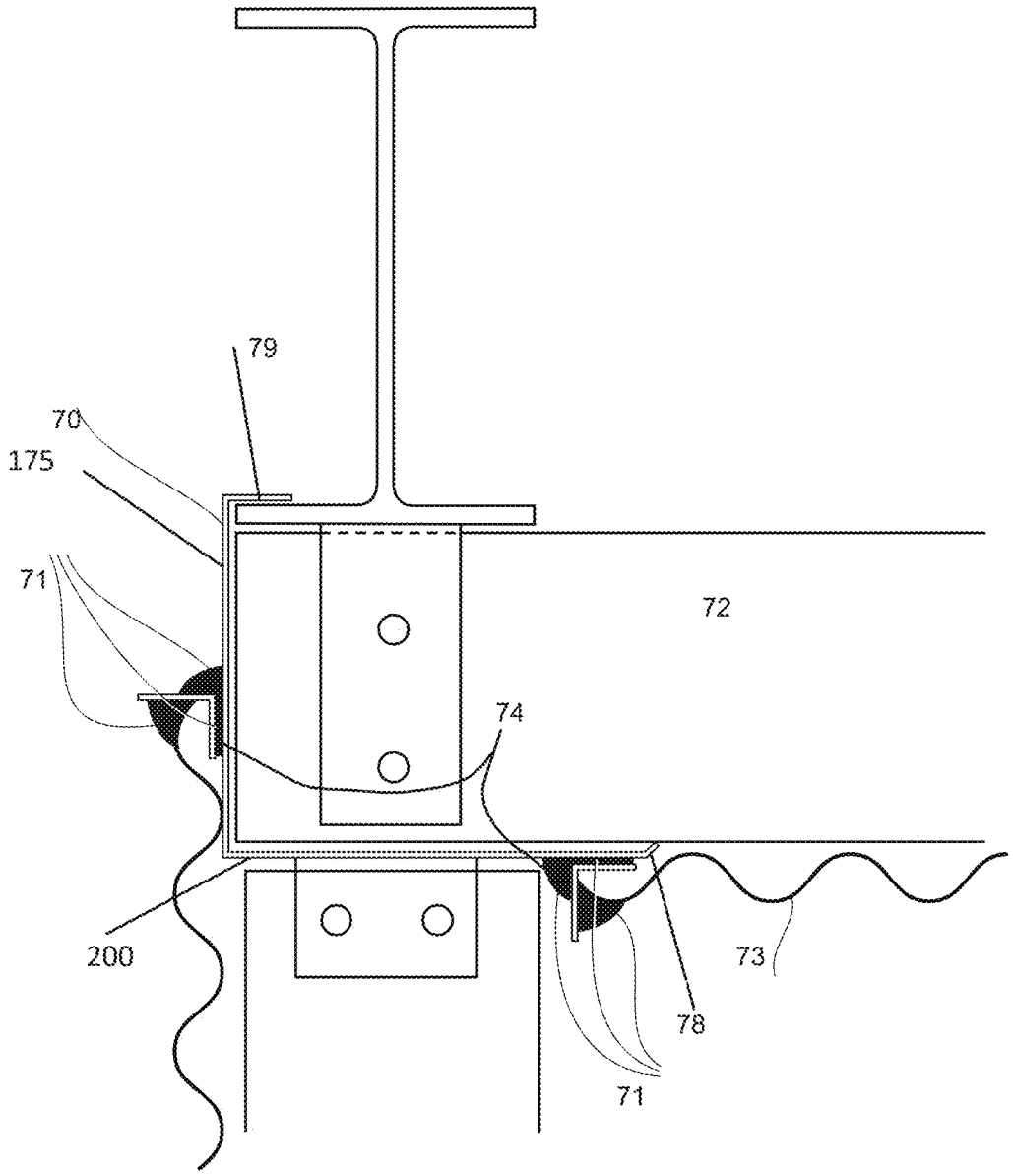
FIG. 13 is a plan view of a door end corner of the shed structure, which shows sealing arrangements.
Figure 14:
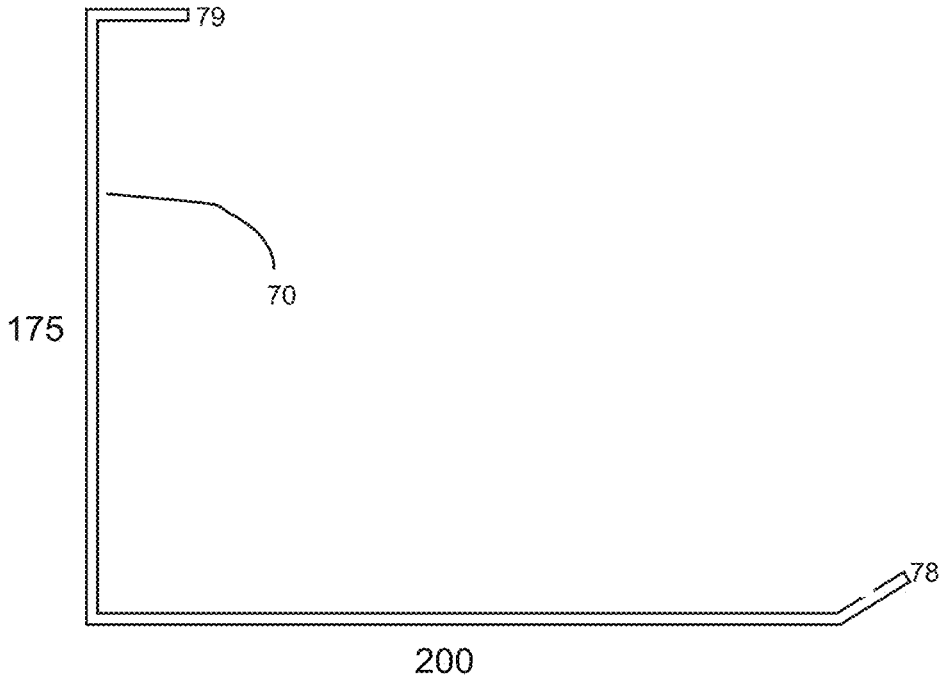
FIG. 14 is a plan section view of a door end flashing to facilitate sealing.
Figure 15:
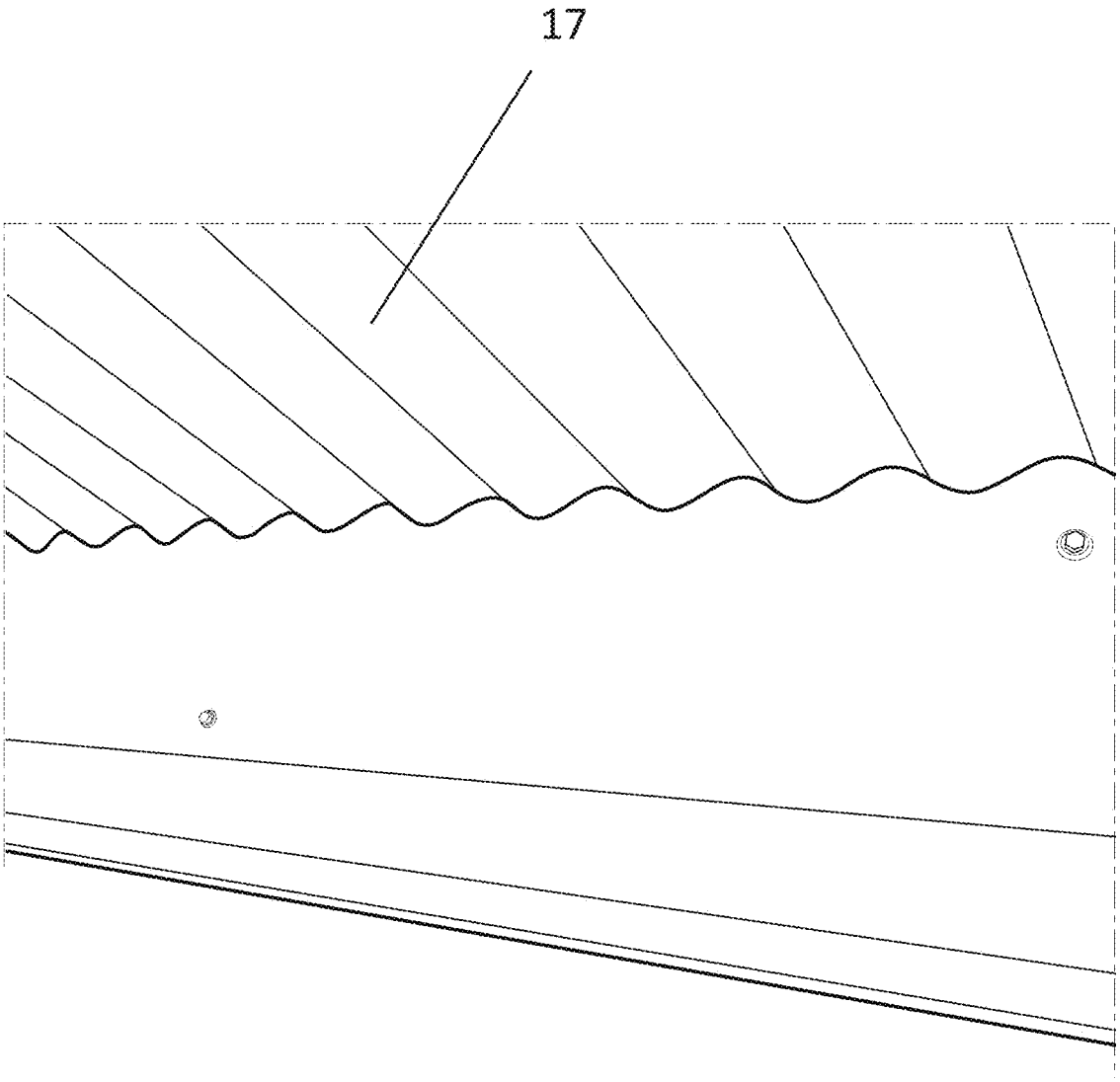
FIG. 15 is a detail view of an upper inside edge of the shed shown in FIG. 10, showing scalloped sealing plate.

In FIG. 5, a peripheral angle 75 is mounted along the floor periphery at the door end, providing a sealing face against which the door panel 37, 38 closes. It is further shown in FIG. 13, which is a plan view of a door end corner of the shed structure, the sealing arrangements including a door end flashing 70, flex and seal material 71, a 15D15 purlin 72, and Custom Orb (corrugated) roofing element 73. FIG. 14 is a plan section view of the door end flashing 70 to facilitate sealing. The door end flashing 70 provides a seal between the door end wall 74 and adjacent roof/wall junction. The flex and seal 71 is disposed between the flashing 70 and wall 74 to provide a flexible seal against the wall corrugations 73. The 15D15 purlin 72 supports the roof structure at the door end, while the Custom Orb (corrugated) 73 roofing element overlaps the purlin. The section view of FIG. 14 further shows a clear structure of the door end flashing 70 as an angle with one arm 175 mm long and another arm 200 mm long, and returns on its distal edges 40 and 78, the latter facilitating the seal discussed in FIG. 13.

It will be understood to persons skilled in the art of the invention that many modifications may be made without departing from the spirit and scope of the invention.

It is to be understood that any prior art publication referred to herein does not constitute an admission that the publication forms part of the common general knowledge in the art.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A pressurized storage shed configured to store items under pressure, the pressurized storage shed including:

a floor, wherein the floor includes a concrete slab and a bund mounted on the concrete slab, the bund disposed around at least a portion of the perimeter of the floor to form a peripheral embankment, wherein the bund includes a substantially vertical wall on an outside face and fasten to the peripheral embankment;

one or more spaced apart walls attached to the substantially vertical wall of the bund;

a roof;

a door arrangement including:

at least one door panel;

a peripheral angle for providing a face for the door panel to close against;

one or more hinges disposed on the door panel for swinging the door panel between a closed position in which the door is forced against the face of the peripheral angle, and an open position in which the door panel is distal to the peripheral angle;

a latch assembly which includes a rotatable locking post having a longitudinal axis, a handle configured to rotate the rotatable locking post about the longitudinal axis between a locked position and an unlocked position, a latch plate mounted to a lower end of the rotatable locking post and disposed at a base of the door panel, and a catch plate mounted on a ground potion in front of the door panel so the catch plate extends above the ground portion, the catch plate being generally coplanar with the latch plate, the catch plate further including a wall facing the door, wherein when the rotatable locking post is in the locked position, the latch plate abuts the wall of the catch plate latching the catch plate against, the door arrangement during the rotation of the handle, forcing the door arrangement against the wall of the peripheral angle, thus, sealing the door panel to seal the shed, and when the rotatable locking post is in the unlocked position the latch plate is configured to rotate away from the wall of the catch plate allowing the door panel to swing to the open position, and wherein the walls, the roof and the floor provide a storage volume and are sealed together to inhibit ingress of vermin and to maintain a selected ambient pressure inside the storage volume, and a pressure relief valve operatively connected to the floor, the roof or the wall to relieve internal pressure in the storage volume.

2. The storage shed in accordance with claim 1, wherein the pressure relief valve includes:

a housing including:

a sump for storing a working liquid;

a gas inlet chamber;

a gas outlet chamber; and a gas inlet in fluid communication with the housing;

a gas outlet in fluid communication with the housing;

a baffle in the housing, the baffle having two opposing sides, and wherein the gas inlet chamber and the gas outlet chamber are separated by the baffle which extends into the sump.

3. The storage shed in accordance with claim 2, wherein the gas inlet chamber and gas outlet chamber are disposed above the sump, adjacent the baffle.

4. The storage shed in accordance with claim 3, wherein the working liquid for storing in the sump is oil.

5. The storage shed in accordance with claim 4, wherein the housing includes an indicator for indicating a fluid level in the sump.

6. The storage shed in accordance with claim 5, wherein the indicator includes a window in the housing.

7. The storage shed in accordance with claim 6, wherein the window extends to either of the two opposing sides of the baffle to indicate the level of liquid on both inlet and outlet portions of the sump.

8. The storage shed in accordance with claim 5, wherein the indicator includes two windows in the housing and wherein one of the two windows is on a first side of the baffle, and a second of the two windows is positioned opposite to the one window on a second side of the baffle, so as to indicate the level on both inlet and outlet sides of the baffle.

9. The storage shed in accordance with claim 2, wherein the gas inlet is disposed in an upper portion of the housing, so as to introduce gas to the gas inlet chamber.

10. The storage shed in accordance with claim 2, wherein the sump includes an inlet portion and an outlet portion, the inlet portion being disposed on an inlet side of the baffle and the outlet portion is on the other side of the baffle.

11. The storage shed in accordance with claim 1, further including a catch assembly, the catch assembly including:

a base plate configured to be set into the floor of the storage shed;

wherein the catch plate is mounted on top of the base plate for catching the latch plate against one face thereof.

12. The storage shed in accordance with claim 1, wherein the vertical wall of the bund is scalloped to receive a wall sheet having a cooperating scalloped or sinusoidal profile thereagainst.

13. The storage shed in accordance with claim 1, wherein the bund includes an angled wall portion on an inside face to facilitate drainage or sliding of bulk grain or other material onto the floor for removal.

14. The storage shed in accordance with claim 1, further comprising a fumigation inlet to provide pressurized gas into the shed.

15. The storage shed in accordance with claim 14, wherein the fumigation inlet includes a valve for controlling fumigant access to the shed.

16. The storage shed in accordance with claim 15, wherein the valve is mounted substantially on an inside face of at least one of the door panels.

17. The storage shed in accordance with claim 15, wherein the fumigation inlet includes a housing mounted on at least one of the door panels, the housing being to house the valve.

18. The storage shed in accordance with claim 15, wherein the valve is a ball valve.

19. The storage shed in accordance with claim 1, further comprising a roof flashing element which is configured to facilitate a roof seal, a central spine having a first side and a second side, and the roof flashing element in the form of a Z-section which includes an angle on the first side and second side of the central spine section, wherein portions of the Z-section are configured to receive one or more sealant beads.

20. The storage shed in accordance with claim 19, wherein the roof flashing element further includes a flange extending from one angle of the Z-section to provide a channel adjacent the angle section.

21. The storage shed in accordance with claim 1, wherein the bund includes a vertical wall on a portion of the inside face to improve strength.

* * * * *